United States Patent [19]

French

[11] Patent Number: 5,020,256

[45] Date of Patent: Jun. 4, 1991

[54] ESCALATOR ADVERTISING

[76] Inventor: Andrew B. French, 173 Sydney Road, Fairlight, New South Wales, 2094, Australia

[21] Appl. No.: 302,748

[22] PCT Filed: May 18, 1988

[86] PCT No.: PCT/AU88/00151

§ 371 Date: Feb. 27, 1989

§ 102(e) Date: Feb. 27, 1989

[87] PCT Pub. No.: WO88/09545

PCT Pub. Date: Dec. 1, 1988

[30] Foreign Application Priority Data

May 21, 1988 [AU] Australia ..... PI2126

[51] Int. Cl.[5] ..... G09F 3/18

[52] U.S. Cl. ..... 40/661; 40/584

[58] Field of Search ..... 40/584, 661, 649, 642; 198/335, 324; D34/30

[56] References Cited

U.S. PATENT DOCUMENTS

| | | | |
|---|---|---|---|
| 1,489,113 | 4/1924 | Brookbank | 40/320 |
| 1,729,961 | 10/1929 | Partridge | 40/661 |
| 1,786,123 | 12/1930 | Murphy | 40/661 |
| 2,023,573 | 12/1935 | Bury | 40/565 |
| 4,149,331 | 4/1979 | Prager | 40/649 |

FOREIGN PATENT DOCUMENTS

| | | | |
|---|---|---|---|
| 28874 | 5/1971 | Australia . | |
| 15638 | 12/1983 | Australia . | |
| 16130 | 1/1984 | Australia . | |
| 2276649 | 1/1976 | France | 40/320 |
| 2498354 | 7/1982 | France | 40/647 |
| 2610751 | 8/1988 | France | 40/594 |
| 660506 | 2/1964 | Italy | 198/335 |

*Primary Examiner*—John G. Weiss
*Assistant Examiner*—Michael Lynch
*Attorney, Agent, or Firm*—Amster, Rothstein, Ebenstein

[57] ABSTRACT

A hand rail for a moving walkway, escalator or the like having a cover of transparent material substantially thereover, such that advertising material and/or printed material placed on the hand rail may be seen through the cover. The cover may be manufactured separately from the hand rail such that it may be removed therefrom, permanently affixed thereto, or hinged therefrom. The cover may also be manufactured integrally as part of the hand rail. Alternatively, the cover may be hardenable liquid such as plasticized PVC.

18 Claims, 2 Drawing Sheets

ESCALATOR ADVERTISING

The present invention relates to advertising and more particularly to advertising upon moving walkways, escalators and the like where a holding rail or band is utilised.

Advertising has appeared on stairs and the structures of such apparatus as elevators and stairways. However, the holding or hand rails on escalators and moving walkways have not been utilised for the purpose of advertising.

It is an object of the present invention to provide hand rail, for a moving walkway or escalator, which allows advertising to be inserted therein and seen therethrough.

In one broad form, the present invention comprises a hand rail for a moving walkway, escalator or the like having a cover of transparent material substantially thereover such that advertising material and/or printed material placed on said hand rail may be seen through said cover.

According to another aspect of the present invention there is disclosed a hand rail and a hand rail cover, said cover being adapted to be located over said hand rail to protect printing and/or printed material on said hand rail, and allow said printing to be visible.

The cover can be formed integrally with the hand rail, and a means of pivoting may be provided. Alternatively the cover can be a one piece item which snaps into place over the hand rail.

A two piece cover can also be utilised, the bottom half being snapped into position over the hand rail whilst the top half is pivotable to cover advertising and/or printed material placed on the exposed surface of the bottom half.

According to another aspect of the present invention there is disclosed a method of applying advertising material or the like to a hand rail, said method comprising the steps of:

locating a sheet material having said advertising material thereon, or inscribing, painting, etching or like process of said advertising material to said handrail;

and, applying a covering of transparent material over said advertising material.

The cover can be in the form of a liquid substance which dries to form a solidified coating. The coating or cover can protect the printed matter from vandalism, or its removal and scratching by normal operation of the hand rail.

According to another aspect of the present invention there is disclosed a hand rail having a recess provided therein for the insertion of printing or printed material whereupon once said material has been inserted in said recess a cover allowing said material to be seen is placed in said recess. This will aid in the prevention of scratching of such a cover if same is of clear plastic material or the like.

According to another aspect of the present invention there is disclosed a hand rail being constructed of clear material and being adapted to receive information displayed through said clear material.

In another version of the present invention there is provided a hand rail having a clear upper body with conventional material therebeneath, information being placed between said clear material and said conventional material.

According to a further aspect of the present invention there is disclosed the provision of pockets in a hand rail of clear construction or part clear construction wherein said pockets are adapted to receive printed material and a cover if necessary.

Various preferred embodiments of the invention will now be described with reference to the accompanying drawings, in which:

FIG. 4 illustrates another embodiment of the present invention wherein said hand rail is manufactured solely from clear material and includes pockets and the like.

Figure 1:
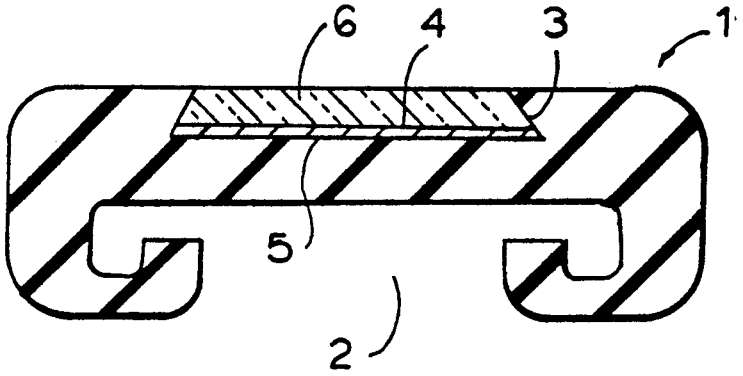
FIG. 1 illustrates a cross-section of a first embodiment of the invention, showing a hand rail of the conventional type ultilised on escalators and many footways, having modifications for receiving and displaying advertising material.

As illustrated in FIG. 1, the hand rail 1 in accordance with the present invention comprises commonly used shapes and arrangements in the lower portion 2 thereof for receipt by known escalator or walkway componentry. The material of the hand rail 1 is of rubber usually utilised for this purpose, however the hand rail of the present invention differs from conventional hand rails in that a groove and/or recess 3 is provided in the upper portion thereof in which a card constructed of plastic or the like and having printed matter 4 thereon, is in inlaid in the lower portion 5 of the recess 3.

Over the top of the printed material 4 and inside the recess 3 is provided a clear material 6 being a cover to protect the advertisement of printed material 4. The hand rail 1 is then placed on an escalator or moving walkway and if so desired, the advertisement can be oriented so that persons reading the material will not need to twist or orient themselves in order to better view the printed matter. For this purpose the writing can be placed at an angle to the direction of motion so that optimum viewing can be obtained. If so desired, the recess 3 can be provided as a continuous recess over the whole length of a hand rail 1 or discrete lengths of recesses 3 and covers or fillers 6 can be inserted at various intervals along the length of the rail 1.

If a continuous recess 3 is utilised then the cover 6 would best be constructed of material which is flexible, and can be cut and fusable. The reason for this is that maintenance of hand rails has to be carried out when hand rails stretch. This operation includes removal of the hand rail 1, cutting and removal of a portion of the hand rail to remove slack, and then rejoining the ends of the hand rail 1. In providing a flexible fusable cover, the advertising recess can also have said maintenance operation performed at the same time without the need for extra work to be involved. This operation is necessary as the belts 1 tend to stretch during the life of the escalator or hand rail 1 and thus need to be shortened in order for effective operation. If discrete lengths or pockets are utilised then the maintenance engineers can cut the hand rail at a portion between the discrete lengths or pockets so that the same effect can be achieved.

Figure 2:
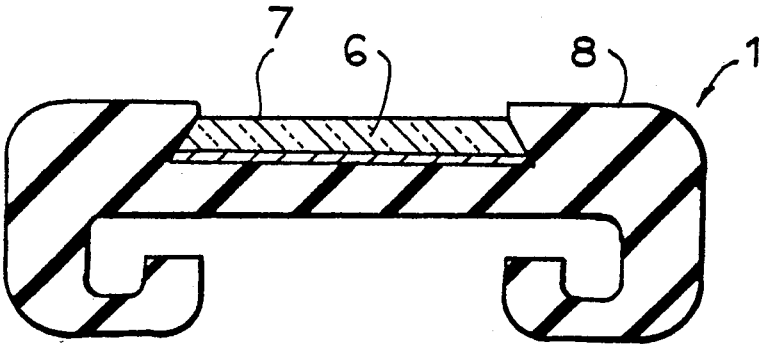
FIG. 2 is an embodiment similar to that of FIG. 1 showing a recess.

Illustrated in FIG. 2 is another embodiment of the present invention, similar to that of FIG. 1, however a recess between the upper surface level 8 of the hand rail 1 and the upper surface level 7 of the cover 6 is provided. By provision of this feature, the usual scratching of the upper surface 7 which occurs on escalators and moving walkways is obviated and therefore protection of the viewing surface 7 of the cover 6 can be achieved.

Figure 3:
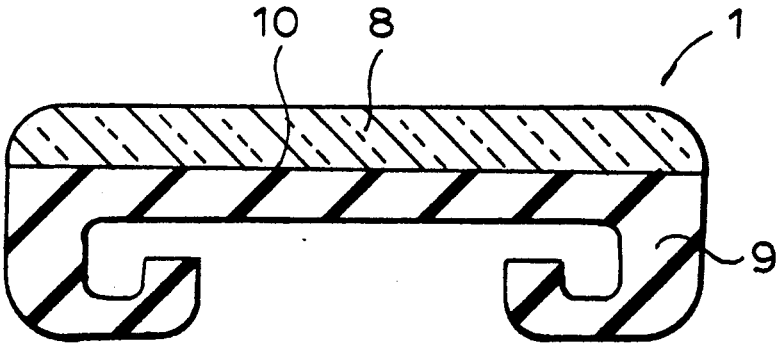
FIG. 3 illustrates a third embodiment of the present invention wherein said hand rail is manufactured solely from clear material and the other half of conventional hand rail material.

In FIG. 3, is illustrated another embodiment of the present invention which illustrates the hand rail 1 having a clear upper body 8 and a lower body 9 constructed of any suitable materials. During the manufacturing process of such a hand rail 1, a plastic card or the like of type-printed material may be inserted between said clear upper body 8 and the lower body 9. The upper and lower parts 8 and 9, respectively, may than be moulded or bonded together. This advertising is not changeable unless the belt is removed completely and a new belt inserted or unless the bond between the upper and lower portions may be fused apart. Plastic advertising material in the form of a card or the like, other material need not be inserted between the plastic 8 and conventional rubber 9. If it is desired either of the surfaces which meet at the line 10 can be painted or moulded with an appropriate message or advertisement.

Figure 4:
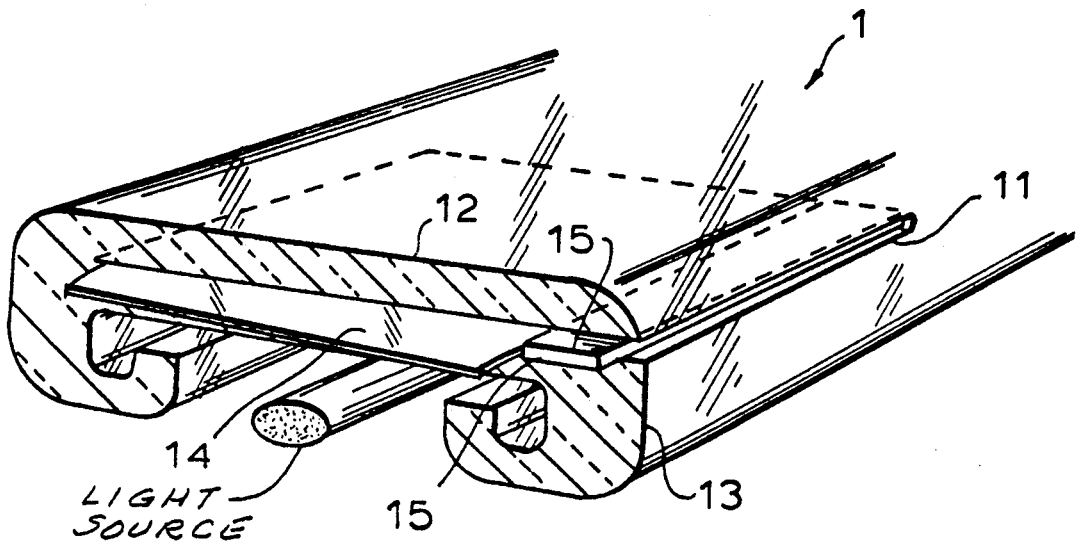

In FIG. 4 a further embodiment of a hand rail 1 utilising a completely clear plastic body with a side pocket 11 provided therein, is illustrated in an isometric view. The pocket 11 may be either of discrete length along the length of the hand rail 1, or can be of a continuous length if so desired. If of continuous length, then a method of securing the upper flap portion 12 to the lower portion 13 would be required. If a discrete pocket 11 is utilised, then after insertion of the advertisement into the recess has been enacted, a plug or other member 15 is preferably inserted into the remaining portion of the pocket 11 for the purpose of preventing access to the advertisement 14. If so desired only the viewing card associated with the printed material need be of a see-through or clear substance, or vice versa.

Figure 5:
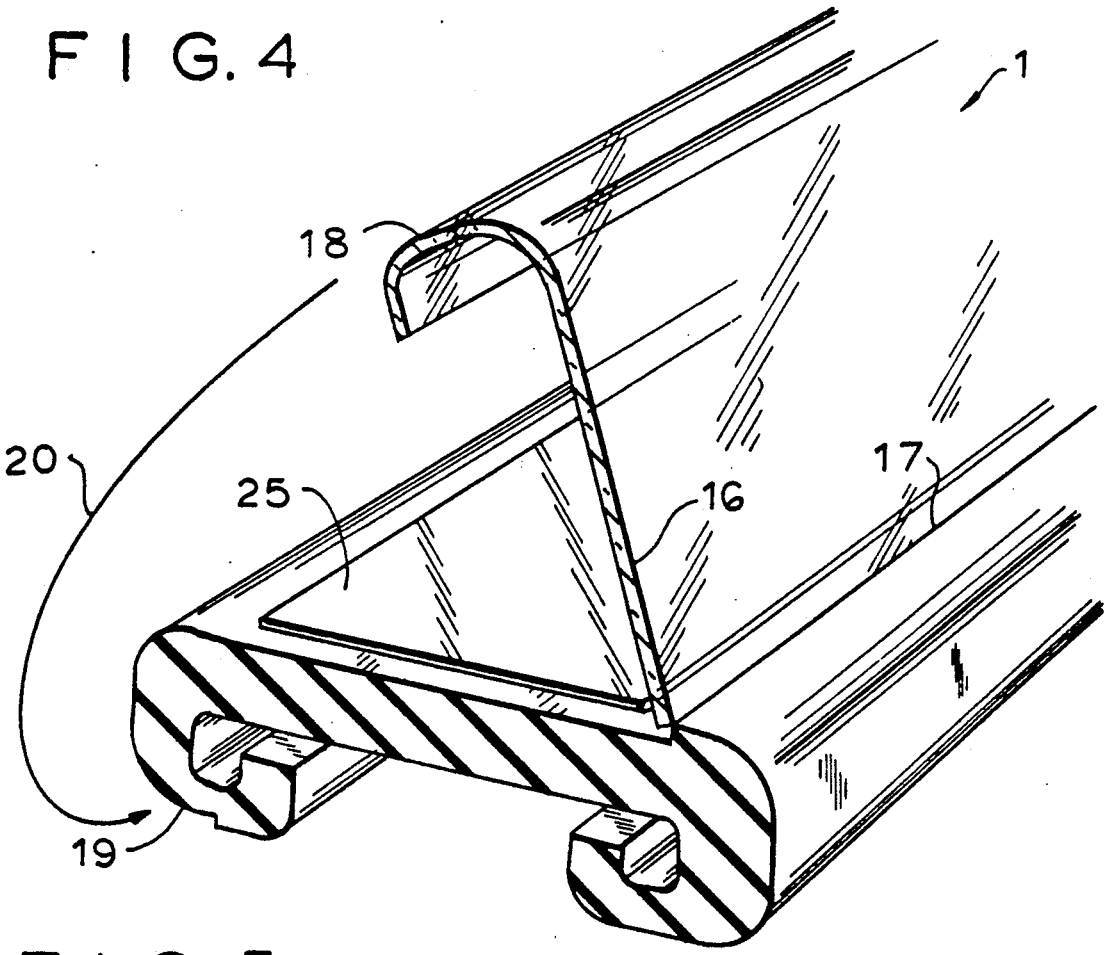
FIG. 5 illustrates a further embodiment of the present invention.

Illustrated in FIG. 5 is a further embodiment of the present invention which comprises a standard hand rail 1 upon which is placed printed matter 25 either directly, in the form of printing, painting, etching, moulding and the like, or indirectly in the form of a card, printed sheet, printed plastic, stickers and the like.

Over this printing is located a substantially solid cover 16 which is joined to hand rail 1 at 17. This join allows the cover 16 to be pivoted which allows access to printing 25. At the other side of cover 16 is located a spring or biased portion 18 which then snaps over the bottom portion 19 of the hand rail 1. Portion 18 is moved against a bias in direction of arrows 20.

The cover 16 can also be in the form of a two piece construction. The first piece being a cover having two sides similar to the portion 18 which is biased. A second piece being pivotally attached to the first piece in a similar manner as the cover 16 is connected to hand rail 1 at 17. In this version, the printing 25 is placed on the first piece and not on the hand rail per se. This is particularly suitable where the hand rail is not in good condition.

Another cover in the form of the first piece alone (mentioned in the previous paragraph) can be utilised to cover the printing 25 when placed directly on hand rail 1.

Another embodiment for which there is no illustration comprises the placing of printing or the like in what ever form, onto the hand rail 1, over this is applied a coating in the form of a hardenable liquid which is not opaque when it dries. This coating, such as plasticised PVC or the like can protect the printing from scratching, removal by vandals and damage and/or removal from operation of the hand rail mechanism. Suitable plasticised PVC coatings or the like should be flexible to allow the hand rail to travel around its path, they should be heat resistant such that a fire hazard is obviated, and preferably, they should result in a shiny, smooth, and suitable slippery surface to ensure correct operation of the hand rail.

In another embodiment of the present invention there is means for applying the printed material by a heat stamping method. This can be either heat stamped to the embodiments previously described or onto existing hand rails.

A further embodiment allows for the directing of a light from beneath the hand rail, to pass through an advertisement or printed material already in the hand rail. A built in lightsource in the hand rail is one means of performing same.

A reflective type advertisement or printed matter can be utilised, with light to energise same coming from above.

Further, luminescent printing can be utilised so that a light source will energise the luminescent printing underneath the machinery, so that when the printing is used by a passenger it will "glow in the dark".

If so desired, the embodiments of the present invention, except where mentioned, can be applied to hand rails having a specially raised section to accommodate such printing. This may require the re-designing of the machinery in use for operating the hand rail in order to prevent damage or revolting of the printing or printed area.

The drawings which accompany this specification do not necessary represent the exact shape, configuration or cross section of a hand rail, it will be readily understood from the specification and drawings the means by which this invention can be utilised and put into effect regardless of the shape and configuration of the hand rail.

The foregoing describes some embodiments of the present invention, and some of these embodiments can be incorporated in other embodiments by excluding some of those features. For example in the drawings of FIGS. 3 and 4 a recess can be provided over the area which displays the advertisement to prevent scratching of the viewing surface.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A hand rail for a moving walkway, escalator or the like having a cover of transparent material substantially thereover such that advertising material and/or printed material placed on said hand rail may be seen through said cover, wherein said cover of transparent material is constructed as the upper portion of said hand rail.

2. A hand rail as claimed in claim 1, wherein said hand rail is provided with at least one cutout portion extending about the longitudinal axis thereof, such that, in said at least one cutout portion, a card or the like inscribed with said advertising and/or printed material may be positioned, and said cover is then provided over said card, wherein said cover is adapted to be firmly but removably retained within said cutout portion.

3. A hand rail as claimed in claim 1, wherein said upper cover portion of said hand rail is fused or glued to a lower portion of said hand rail after placement of said advertising material therebetween.

4. A hand rail as claimed in claim 1 wherein a pocket is provided in one side of said hand rail between said upper portion and a lower portion thereof, into which said advertising material may be placed.

5. A hand rail as claimed in claim 4, wherein, after insertion of said advertising material within said pocket, a plug or the like is inserted therein.

6. A hand rail as claimed in claim 1, wherein said cover is comprised of, a window portion fixedly or detachably secured along one edge thereof to said hand rail, and a spring or biased portion adapted to be retained over the other side of said hand rail.

7. A hand rail as claimed in claim 1, wherein said cover is comprised of a window portion with spring or biased edge portions provided on either side thereof, wherein, after placement of said advertising material on said handrail, said cover is adapted to be retained over said handrail by said spring or biased portions engaging over the edges thereof.

8. A hand rail as claimed in claim 1, wherein said cover of transparent material is a coating of hardenable liquid.

9. A hand rail as claimed in claim 8, wherein said coating is plasticised PVC or the like.

10. A hand rail as claimed in claim 1, wherein a light source is provided within said hand rail to illuminate said advertising material.

11. A hand rail as claimed in claim 1, wherein said advertising material is wholly or partially comprised of luminescent printing.

12. A hand rail as claimed in claim 1 characterized in that a recess is provided between the upper surface of said hand rail and the upper surface of said cover, thereby to minimize scratching of said cover upper surface.

13. A hand rail as claimed in claim 1 characterized in that said cover and the advertising material and/or printed material are bendable along the longitudinal axis of said hand rail.

14. A hand rail for a moving walkway, escalator or the like, characterised in that an upper portion of said hand rail has at least one cutout portion extending from an upper surface of the hand rail about the longitudinal axis thereof, an upper longitudinal edges of said cutout portion having a pair of lips along the openings of said cutout portion directed inwardly towards the center of said hand rail;

a card or the like, inscribed with advertising and/or printed matter, is positioned over the lower surface of said cutout portion; and a cover of transparent material is provided over said card or the like, said cover being correspondingly shaped and adapted to be firmly but optionally removably retained within said cutout portion by said inwardly directed lips.

15. A hand rail for a moving walkway, escalator or the like characterised in that said hand rail is molded such that an upper portion is provided with at least one pocket extending from a first side of said hand rail longitudinally therethrough substantially coplanar to an upper surface of said hand rail, said at least one pocket being adapted to receive a card or the like inscribed with advertising material and/or printed material or the like within said at least one pocket;

a plug or the like is firmly but optionally removably inserted in said at least one pocket in abutting relationship with said first side of said hand rail;

wherein at least said upper portion of said hand rail above said card or the like is constructed of transparent material.

16. A hand rail for a moving walkway, escalator or the like characterised in that an upper portion of said hand rail is provided with at least one window member hinged along a first edge thereof to a first longitudinal side of said hand rail and removably retained along a second edge thereof by a spring or biased portion adapted to be retained over a second longitudinal side of said hand rail, such that a card or the like inscribed with advertising material and/or printed matter is positionable between said window member and the remaining portion of said hand rail.

17. A hand rail for a moving walkway, escalator or the like, characterised in that an upper portion of said hand rail is adapted to receive a window member longitudinally thereover, said window member having spring or biased edges longitudinally therealong adapted to be removably received over respective sides of said hand rail, such that a card or the like inscribed with advertising material and/or printed matter is positionable between said window member and the remaining portion of said hand rail.

18. A handrail for a moving walkway, escalator or the like with a non-linear travel path having a cover of transparent material substantially thereover such that advertising material and/or printing material placed on such handrail may be seen through said cover, said cover and the advertising material and/or printed material being bendable along a longitudinal axis of said handrail sufficiently to enable said cover and the advertising material and/or printed material to conform to the non-linear travel path of said handrail, and a recess being provided between the upper surface of said handrail and the upper surface of said cover sufficiently to minimize scratching of said cover upper surface during use of said moving walkway, escalator or the like.

* * * * *

UNITED STATES PATENT AND TRADEMARK OFFICE

CERTIFICATE OF CORRECTION

PATENT NO. : 5,020,256

DATED : June 4, 1991

INVENTOR(S) : French

It is certified that error appears in the above-identified patent and that said Letters Patent is hereby corrected as shown below:

ON TITLE PAGE: Item [30],

"May 21, 1988" should be "May 21, 1987"

Signed and Sealed this

Fourth Day of August, 1992

*Attest:*

DOUGLAS B. COMER

*Attesting Officer*

*Acting Commissioner of Patents and Trademarks*